US007937977B2

(12) United States Patent
Booker

(10) Patent No.: US 7,937,977 B2
(45) **Date of Patent: *May 10, 2011**

(54) KEY HOLDER

(76) Inventor: Bruce W Booker, Carbondale, IL (US)

( * ) Notice: Subject to any disclaimer, the term of this patent is extended or adjusted under 35 U.S.C. 154(b) by 601 days.

This patent is subject to a terminal disclaimer.

(21) Appl. No.: 11/842,522

(22) Filed: Aug. 21, 2007

(65) Prior Publication Data

US 2008/0072638 A1 Mar. 27, 2008

Related U.S. Application Data

(60) Provisional application No. 60/839,169, filed on Aug. 22, 2006.

(51) Int. Cl.
*A47G 29/10* (2006.01)

(52) U.S. Cl. ..... 70/456 R; 206/37.1

(58) Field of Classification Search ..... 70/456 B, 70/456 R, 457, 459; 206/37.1–37.8; D3/207–212
See application file for complete search history.

(56) References Cited

U.S. PATENT DOCUMENTS

| | | | | |
|---|---|---|---|---|
| 3,354,678 | A | 11/1967 | Stifelman | |
| 3,407,636 | A | 10/1968 | Boris | |
| 3,680,338 | A | 8/1972 | Lee | |
| 3,765,200 | A | 10/1973 | Vogt | |
| 4,245,486 | A | 1/1981 | Matsumoto | |
| 4,354,368 | A | 10/1982 | Toyoda | |
| 4,440,011 | A | 4/1984 | Klein | |
| 4,569,215 | A | 2/1986 | McCarthy | |
| 4,641,125 | A | 2/1987 | Pesa | |
| 4,901,549 | A | 2/1990 | Dengel | |
| D309,373 | S | 7/1990 | Appelbaum | |
| 5,077,994 | A | 1/1992 | Trull et al. | |
| 5,117,666 | A | 6/1992 | Keefer | |
| 5,123,579 | A | 6/1992 | Sugiyama | |
| 5,168,984 | A | 12/1992 | Walsh | |
| 5,177,989 | A | 1/1993 | Stillwagon | |
| 5,199,560 | A | 4/1993 | Lee | |
| 5,487,291 | A | 1/1996 | Voigt | |
| 6,106,131 | A | 8/2000 | Hao | |
| 6,237,756 | B1 | 5/2001 | Caudle | |
| 7,032,419 | B2 | 4/2006 | Booker | |
| D555,447 | S * | 11/2007 | Bhavnani et al. | D8/34 |
| 7,578,154 | B2 * | 8/2009 | Beresnitzky | 70/459 |
| 2004/0050123 | A1 * | 3/2004 | Macherides et al. | 70/456 R |
| 2004/0185895 | A1 * | 9/2004 | Aisenberg | 455/550.1 |
| 2009/0237209 | A1 * | 9/2009 | Seal et al. | 340/7.21 |

* cited by examiner

*Primary Examiner* — Lloyd A Gall
*Assistant Examiner* — Christopher Boswell
(74) *Attorney, Agent, or Firm* — Polster Lieder Woodruff & Lucchesi, L.C.

(57) ABSTRACT

A key holder, comprising an external housing and an internal housing pivotably mounted inside the external housing. Keys can be retractably mounted in the internal housing with means by which keys can be extended in and out of the internal housing while the internal housing. The internal housing can be rotated in relation to the external housing when the keys are retracted into said internal housing with the keys in the internal housing held under pressure against a plug of soft material to dampen rattling when in a retracted position. The external housing includes an internal chamber sized and configured to contain a larger remote key adjacent the internal housing when the internal housing is retracted into the key holder. Other aspects of the key holder include an integral flash light or cell phone.

8 Claims, 12 Drawing Sheets

KEY HOLDER

CROSS REFERENCE TO RELATED APPLICATIONS

This application claims the benefit of provisional patent application Ser. No. 60/839,169, filed Aug. 22, 2006, which is incorporated herein by reference.

BACKGROUND OF THE INVENTION

The broad aspects of the invention relates generally to key holders for holding at least one key of any type or design. The key holder also may include other useful accessories and features.

U.S. Pat. No. 7,032,419, which is incorporated herein by reference, discloses a key holder with an inner and an outer housing. Keys are held on a ring keeper. The ring keeper is connected to a pin which transfixes the inner and outer housings. The pin has buttons on either end, for easier manipulation. When the pin is drawn up further into the inner and outer housings, the ring keeper is drawn up into the inner housing. At the top of the pin's travel, it is manipulated into a notch, which holds the keys in a retracted position. The inner housing has a hole its side. A plug of soft material is mounted inside the outer housing. When the pin is manipulated into the notch, this causes the inner housing to tilt inside the outer housing, and the keys are brought into contact with the plug of soft material. The plug of soft material dampens movement and rattling of the keys.

Although the patented key holder works well with conventional keys, many vehicles currently use "remote keys" which cannot be held in the key holder. This problem is solved by the improvements in the present aspect of the invention. Also, the present invention provides such a key holder with convenient, space saving accessories

LIST OF REFERENCE NUMERALS

Figure 1:
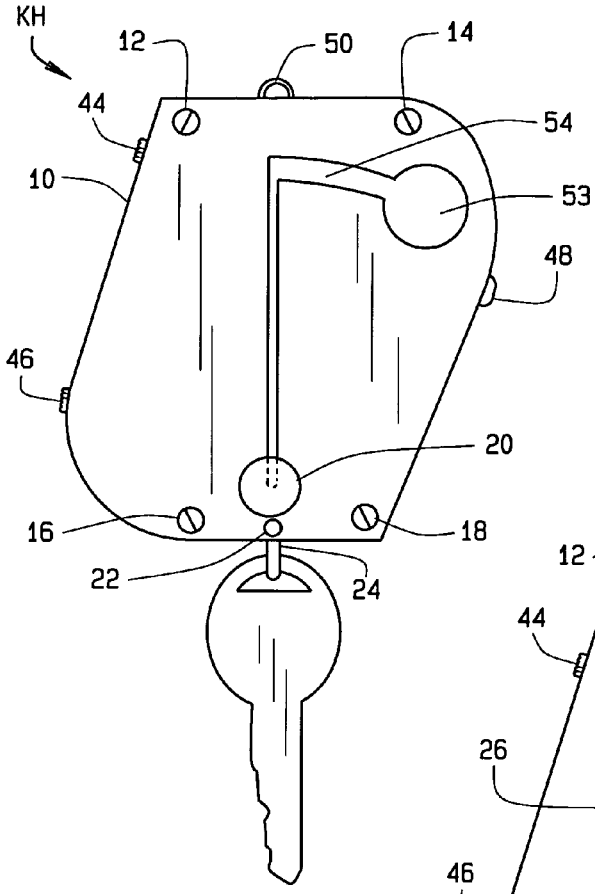
FIG. 1 is a front view of one aspect of a key holder, in extended position.
Figure 2:
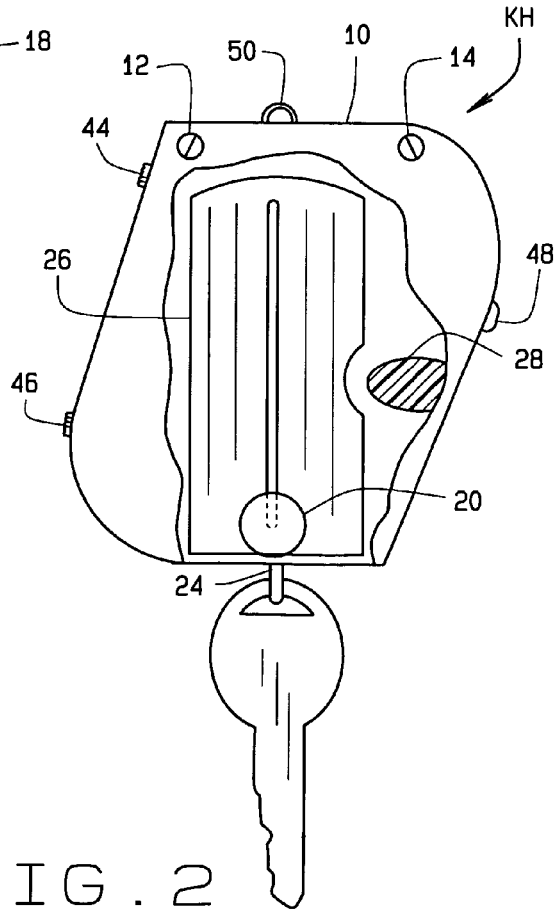
FIG. 2 is a partial cut away front view of the key holder, in extended position
Figure 3:
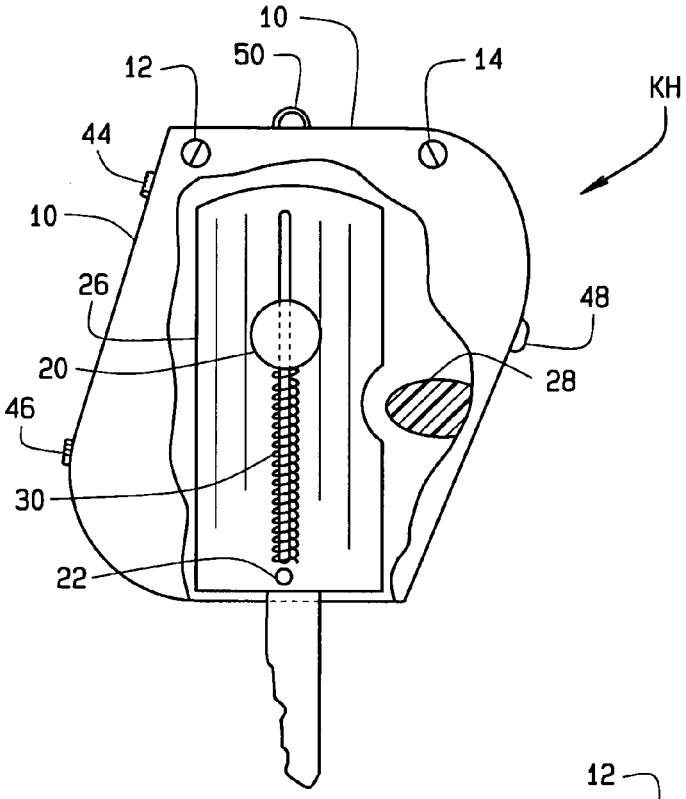
FIG. 3 is a partial cut away front view of the key holder in a partially retracted position.
Figure 4:
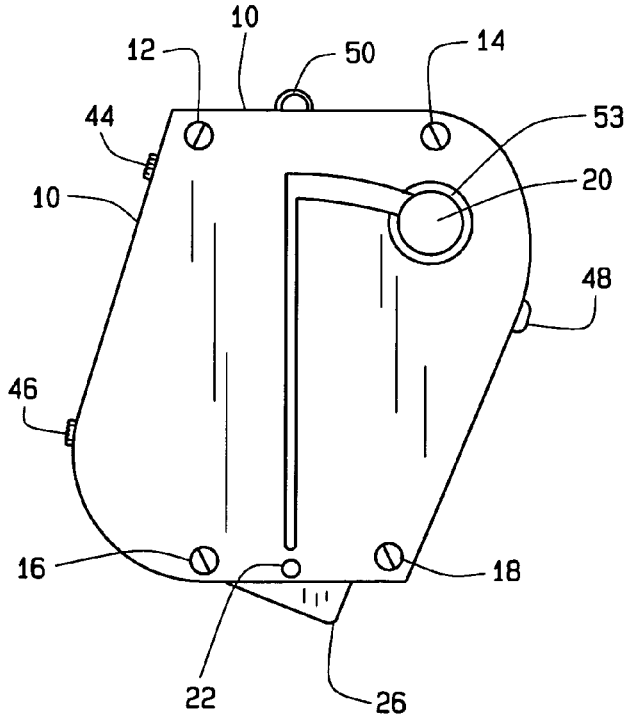
FIG. 4 is a front view of the key holder, in retracted position.
Figure 5:
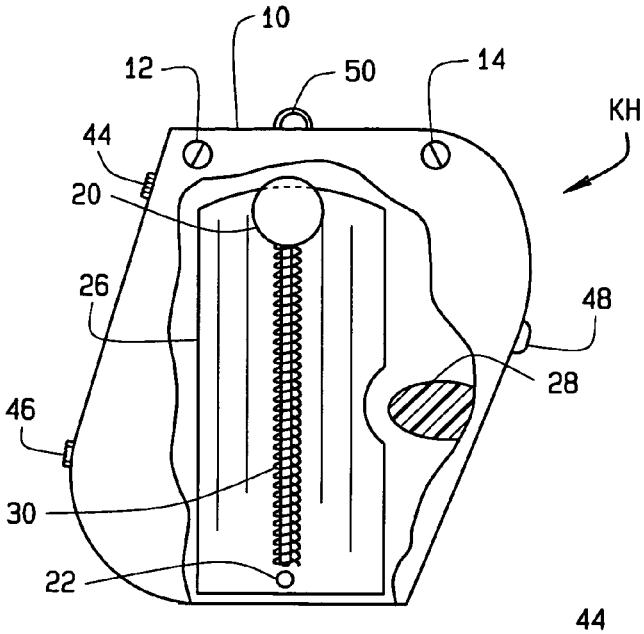
FIG. 5 is a partial cut away front view of the key holder, in a retracted position.
Figure 6:
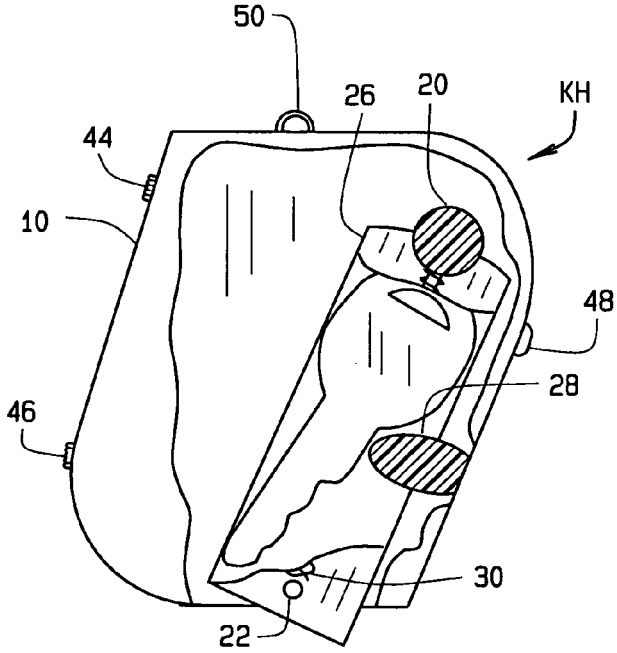
FIG. 6 is a cut away front view of the key holder in fully retracted position.
Figure 7:
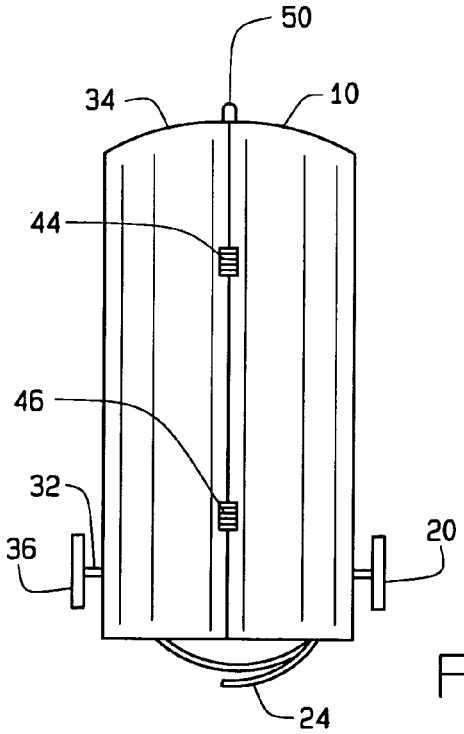
FIG. 7 is an end plan view of the key holder in extended position, without keys
Figure 8:
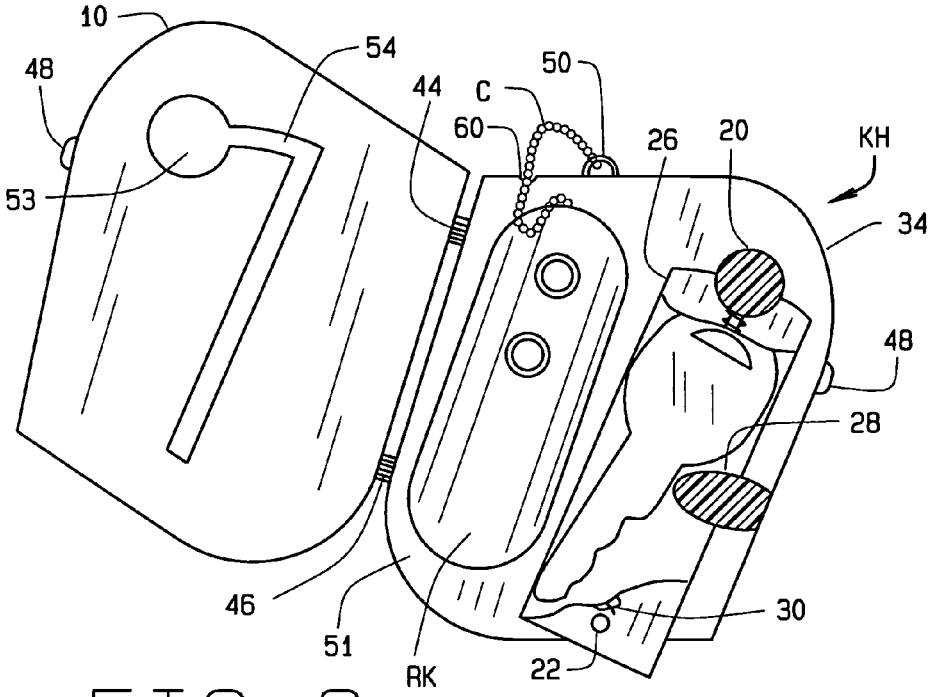
FIG. 8 is a plan view of the key holder, with the front outer housing swiveled open, and a remote key contained in the key holder.
Figure 9:
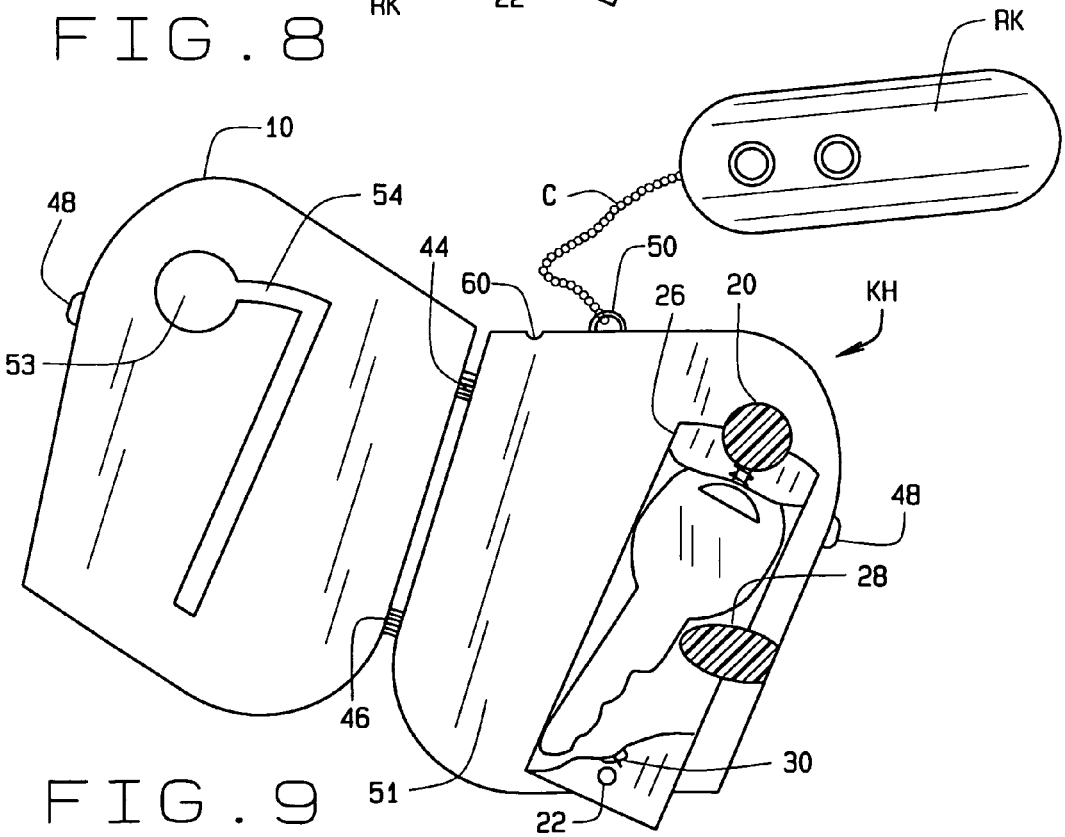
FIG. 9 is a view of the key holder, with the front outer housing swiveled open, and a remote key attached to a loop on the top of the key holder, by a small chain.
Figure 10:
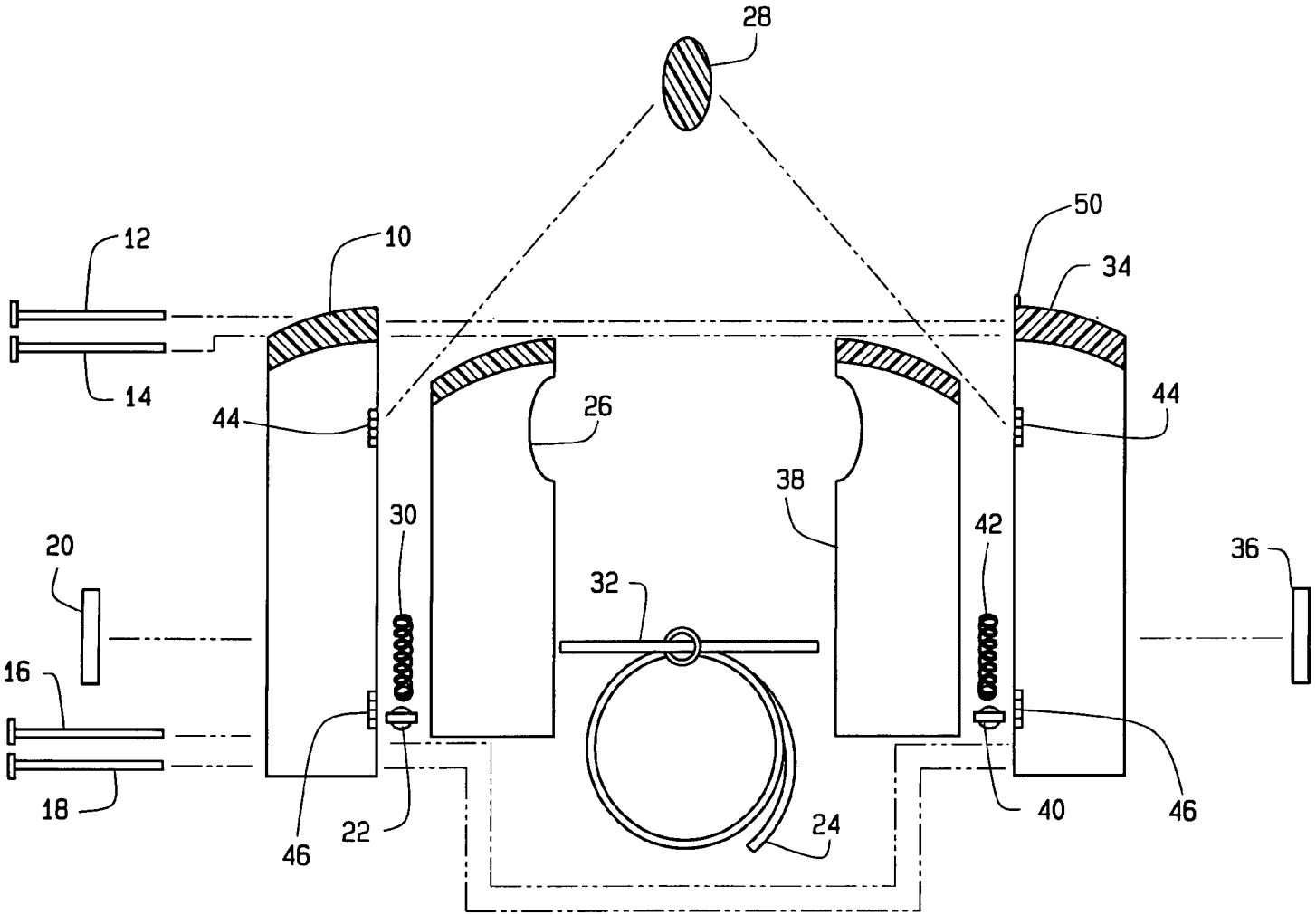
FIG. 10 is an exploded view of the key holder.
Figure 11:
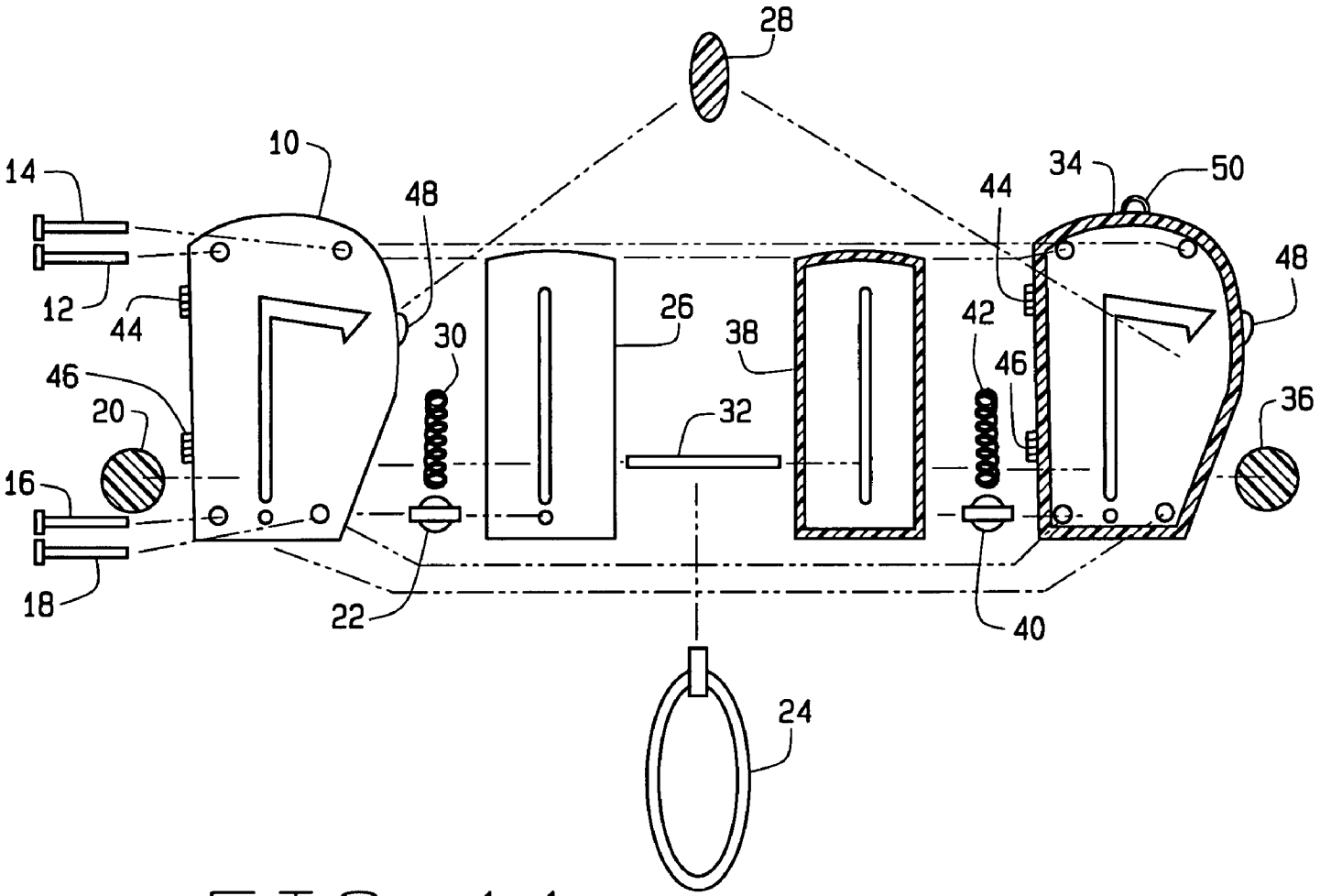
FIG. 11 is an exploded perspective view of the key holder.
Figure 12:
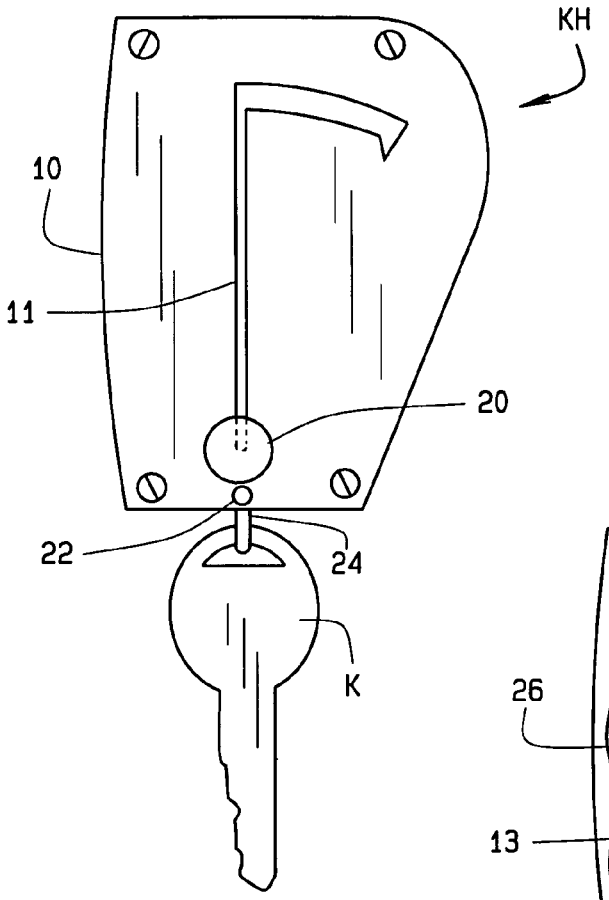
FIG. 12 is the original patented key holder.

10 front outer housing
11 groove
12 top left screw
14 top right screw
13 groove
16 bottom left screw
18 bottom right screw
20 front button
22 front pivot pin
24 keeper
26 front inner housing
28 plug
30 front spring
32 button pin
34 rear outer housing
36 rear button
38 rear inner housing
40 rear pivot pin
42 rear spring
44 top hinge
46 bottom hinge
48 clasp
49 optional watch
50 loop
51 inner chamber
52 securing button
53 button opening
54 notch
55 hook
56 sliding plate
57 spring
59 opening
60 groove or indentation
61 actuation button
62 bulb
63 battery
64 cell screen
65 telephone key pad
66 antenna
67 cell phone circuitry
69 battery
K key
KH key holder
RK remote key
C chain

DESCRIPTION OF THE INVENTION

One embodiment of the key holder KH described herein is illustrated in FIGS. 1 through 14, provides for hinges (44 and 46) on the outer housing, and allowing the front outer housing (10) to swivel open. A clasp (48) keeps the front and back of the outer housings (10 and 34, respectively) from swiveling open, until it is opened by the user. The outer housing (which comprises front and back outer housings 10 and 34 respectively) have also been widened near their bases and define an inner chamber 51 that is sized and positioned to contain a remote key (RK) when the remote key is stored in the key holder.

There is an inner housing comprised of front and rear inner housing (26 and 38), respectively, that can be withdrawn into, or extended partway out of the outer housing. The keys can be held against plug 28 to keep from rattling, all as described in U.S. Pat. No. 7,032,419, which is incorporated herein by reference. It will be noted that a remote key (RK) can be positioned in chamber (51) when the inner housing (and keys therein) is retracted into the key holder, so that all keys are secured in the holder.

There is a loop (50) on the rear outer housing (34) to attach remote key (RK) to the key holder by a small chain (C). An optional small clock (49) or watch may also be placed on the front outer housing (10). There is an opening (53) at the end of a small horizontal portion of the notch (54). Notch (54) allows travel of the button pin (32) to retract or extend the keys. Opening (53) is on the front outer housing (1) is large enough to allow the front button (20) to pass through the notch when front outer housing (10) is opened. A small groove or indentation (60) is made in one or both of the outer housings near the loop (50) to allow a chain (C) to run from the loop to a remote key, while the remote key is contained in the key holder.

Figure 15:
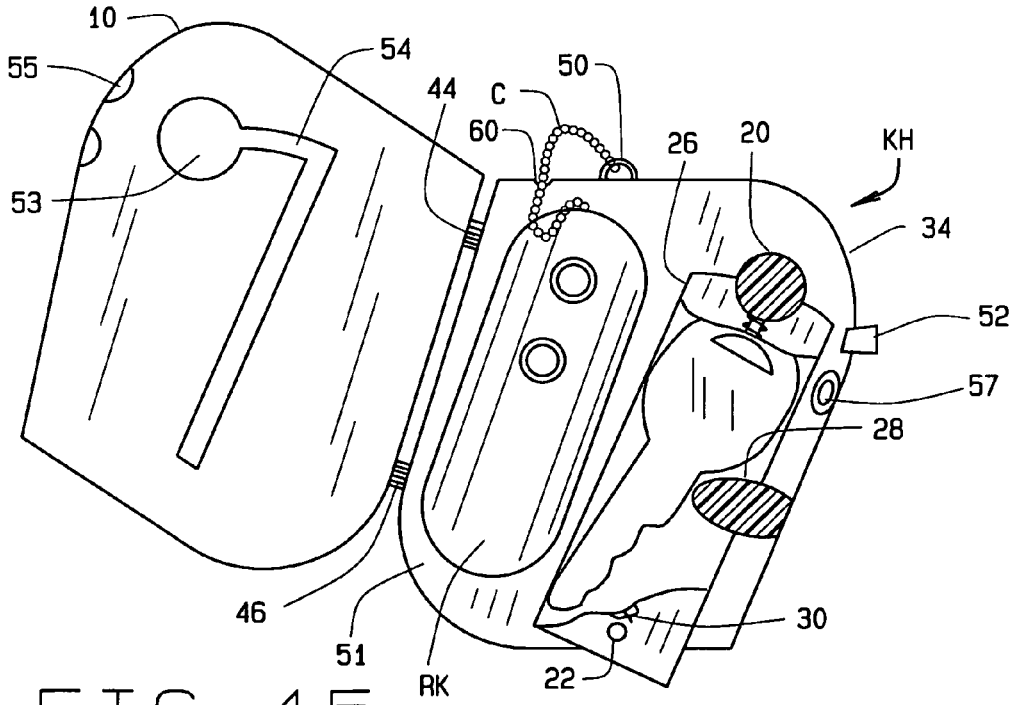
FIG. 15 is a plan view another embodiment of a key holder of the present invention in an open position.

Another aspect of the invention, best illustrated in FIG. 15 in an open position with a remote key contained within, comprises a securing button (52) in place of clasp (48). Also employed is a spring (57) on rear outer housing and hook (55) on the front outer housing, to assist in the opening of the front and rear outer housings (10 and 34, respectively).

Figure 16:
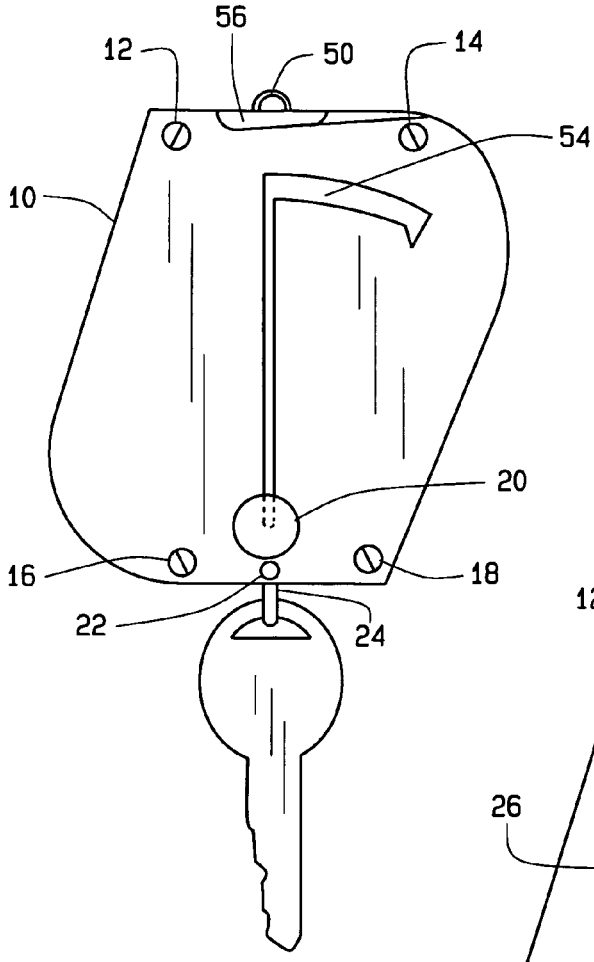
FIG. 16 is a front plan view of another embodiment of a key holder of the present invention with the keys in an extended position.
Figure 17:
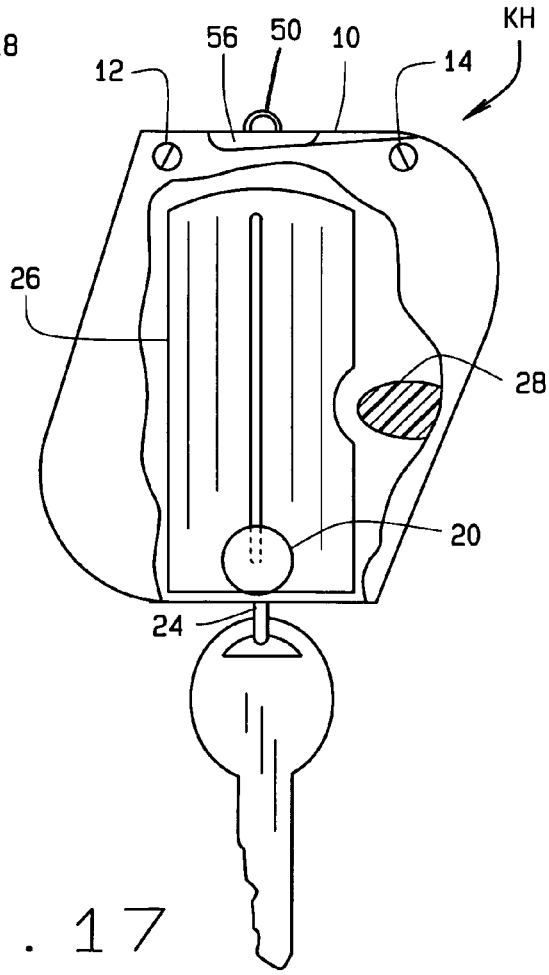
FIG. 17 is a front plan view, partially cut away, of the key holder of FIG. 16

Another aspect of the invention is illustrated in FIGS. 16 and 17 comprises front outer housing (10) and rear outer housing (34) that do not swivel open as above described designs. As can be seen, the bottom left of the key holder (viewed from the front) has been expanded to accommodate a remote key when the key holder is in retracted position, and the inner housing is tilted to the side, which is similar to the embodiments of the key holder described above.

The key holder includes loop (50). A Sliding plate (56) covers the top part of the key holder, and slides on grooves to make an opening at the top of the key holder that will allow the entry or exit of a remote key into or out of the retractable key holder. To keep sliding plate (56) in place when the top of the key holder is closed, friction according to the design of the grooves could be used, or a spring could be mounted inside the outer housings (10 and 34) to keep the sliding plate in a closed position, or bumps, or "snaps" in the grooves that attach sliding plate (56) to the outer housings could be made in such a way that a small amount of force is necessary to move sliding plate (56) to a position that opens the top of the key holder. Any structure that holds sliding plate (56) in a closed position is contemplated by the invention.

When sliding plate (56) is in the open position, there is an opening (59) in the top of the key holder that allows the entry or exit of a remote key (RK). In one embodiment sliding plate (56) does not completely close the top of the key holder to allow a small chain attached between loop (50) and the remote key (RK) to extend into the holder. A groove or indentation (60) in sliding plate (56) or in one of the outer housings could be employed to allow the small chain to run from the remote key RK when contained in the key holder to loop (50) on top of the key holder. Loop (50) could either be on top of sliding plate (56) or located elsewhere on the outer housings of the key holder.

Figure 18:
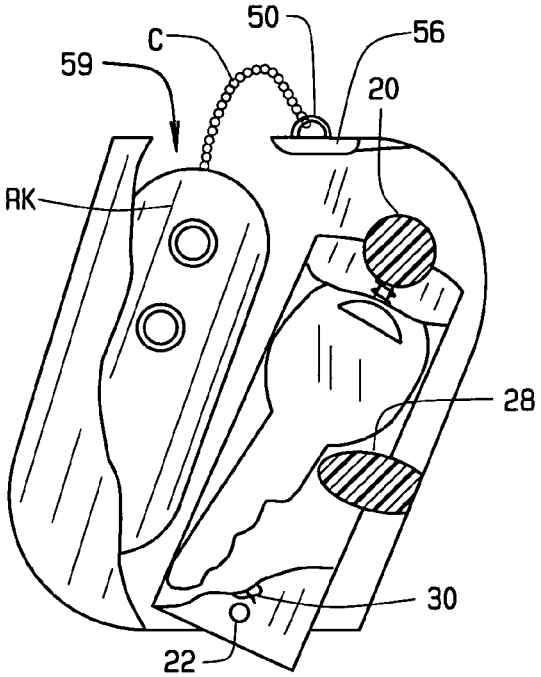
FIG. 18 is another front plan view, partially cut away, of the key holder of FIG. 16 with the keys in a retracted position and a remote key in place.

FIG. 16 is front view with the top of the key holder in a closed position, FIG. 17 as a partial cut away view, again with the key holder in a closed position. FIG. 18 shows the key holder in a retracted position, with the top of the key holder open, and a remote key (RK) contained inside the key holder. Sliding plate (56) can slide to a closed position, containing the remote key inside the key holder.

Figure 19:
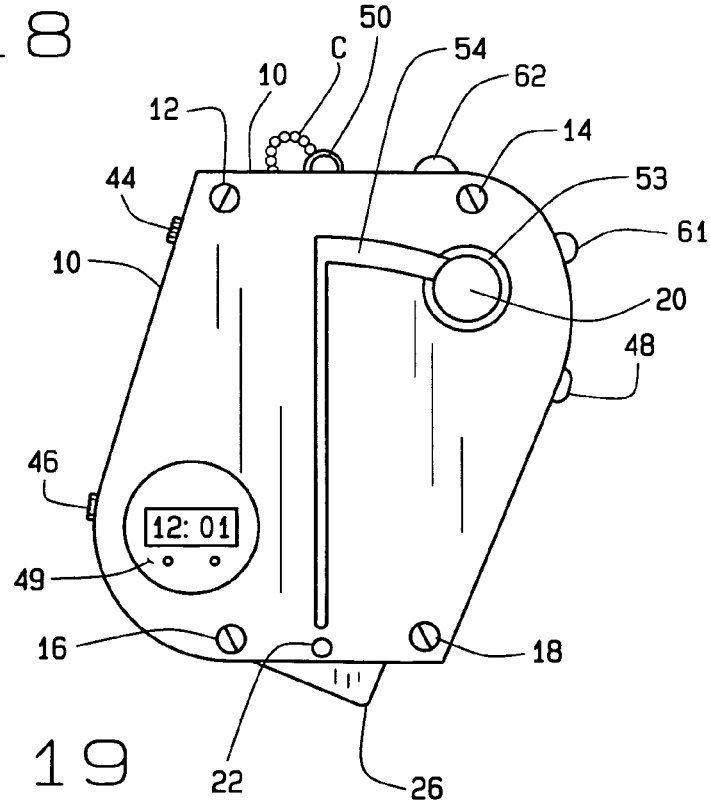
FIG. 19 is a front plan view of a key holder incorporating a clock and flashlight.
Figure 20:
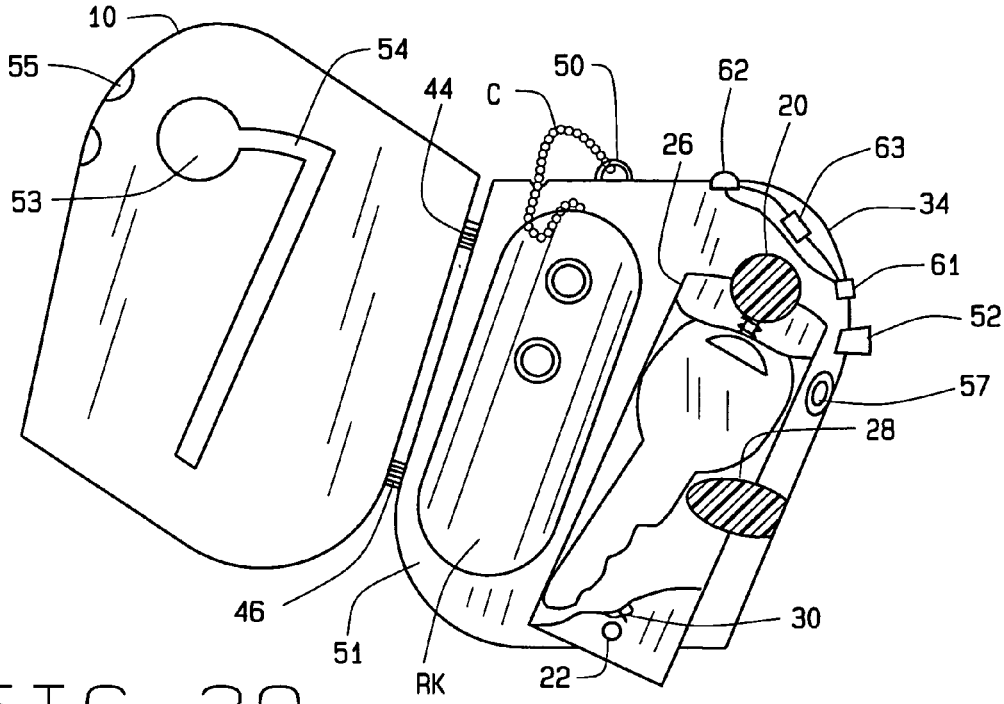
FIG. 20 is the key holder of FIG. 19 in an open position.

FIGS. 19 and 20 illustrate another aspect of a key holder KH constructed similarly to those embodiments described above. Key holder KH includes a watch and a small flashlight. A button 61 actuates a light bulb 62. A battery 63 is operatively connected between the actuation button 61 and bulb to provide power to the bulb.

Figure 21:
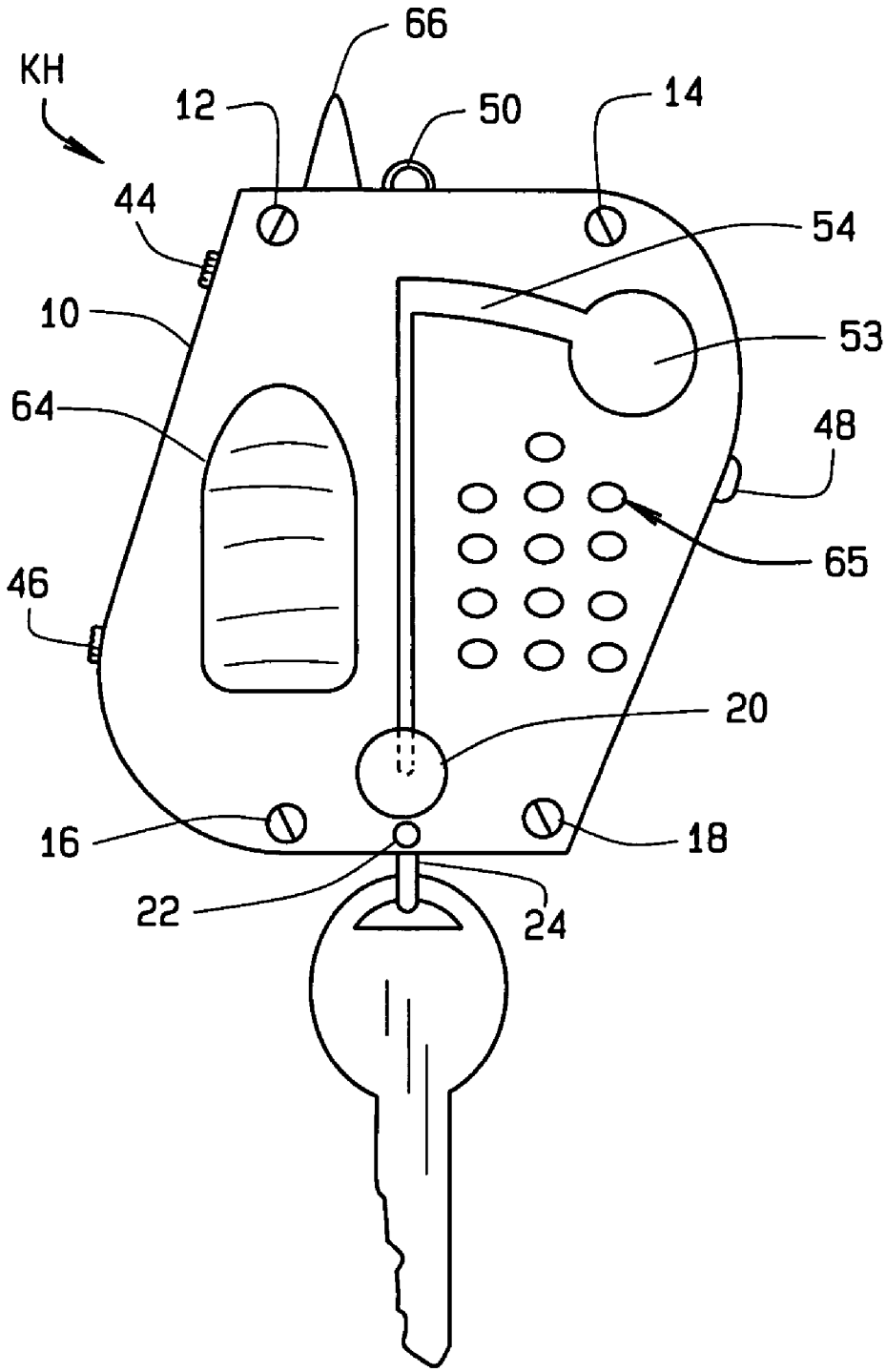
FIG. 21 is a front plan view of a key holder incorporating a telephone.
Figure 22:
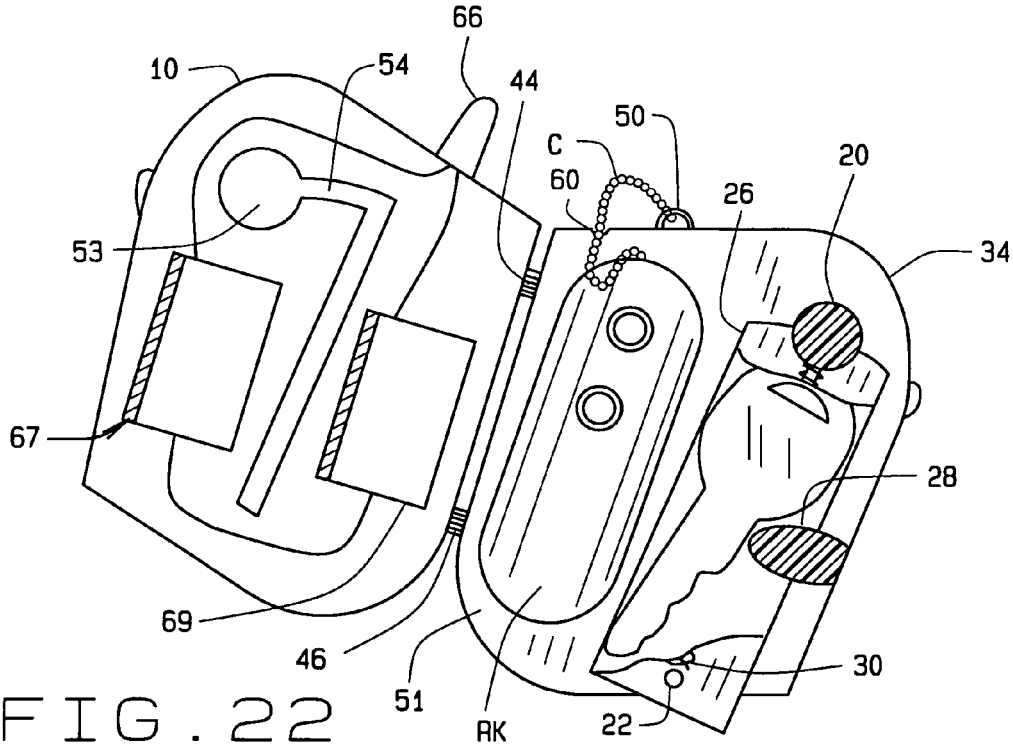
FIG. 22 is the key holder of FIG. 21 in an open position.

FIGS. 21 and 22 illustrate a key holder KH incorporating a cell phone. The cell phone comprises a screen 64, which is substantially flat and incorporated into the case. A key pad 65 is used for entering numbers or text messaging. The buttons are generally flat or actually recessed into the case. An antenna 66 provides improved signal reception. The cell phone has conventional internal components indicated generally by 67 as well as a power source, in this embodiment replaceable battery 69. The internal components and battery are as flat and compact as necessary to fit inside the key holder case.

Figure 13:
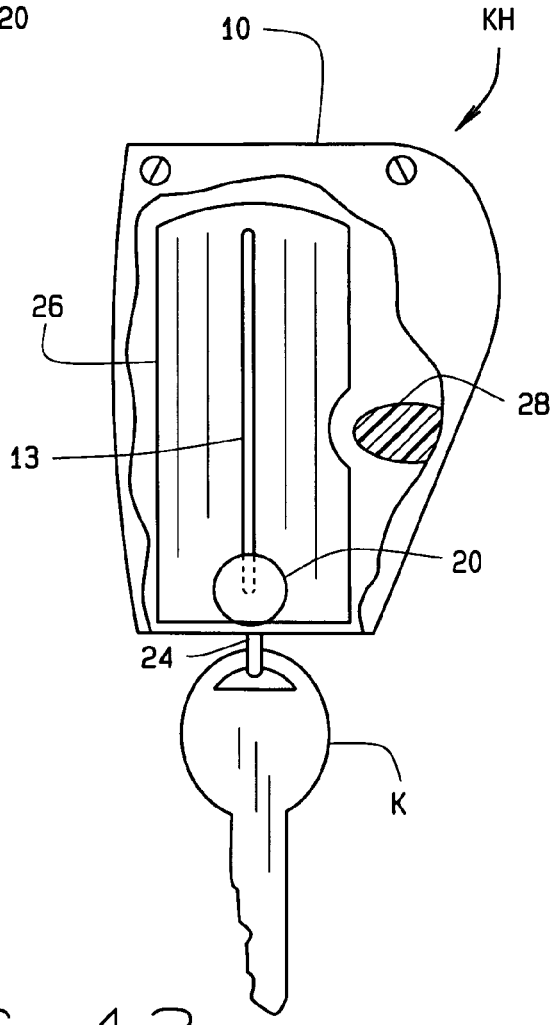
FIG. 13 is the original patented key holder.
Figure 14:
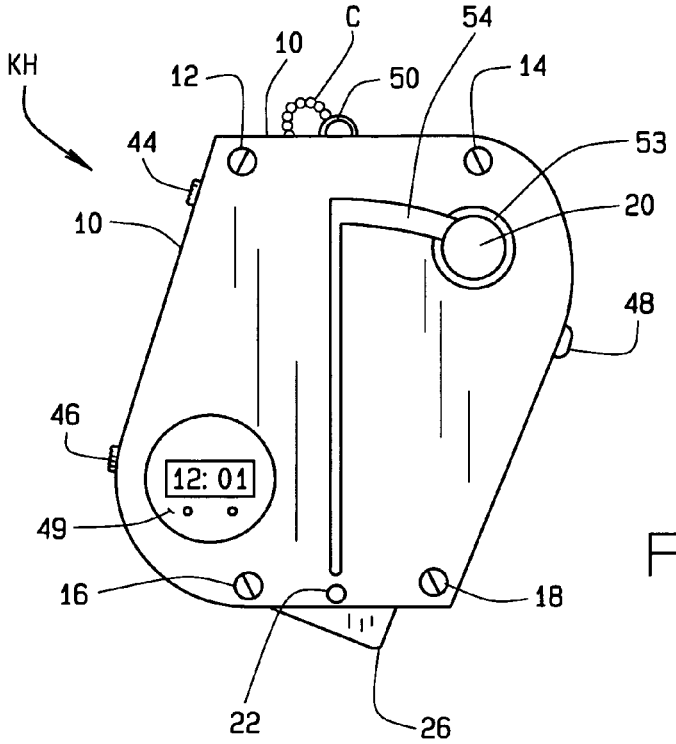
FIG. 14 is a key holder with an optional watch or clock recessed into the front outer housing.

The key holders KH as illustrated incorporates some of the same key retraction and sound dampening features included in the embodiments of FIGS. 13 and 14 as described in U.S. Pat. No. 7,032,419, which is incorporated herein by reference. Briefly described, a key holder capable of retracting keys within itself. The Key holder KH includes an outer case 10 that has a retraction groove 11 in the front wall. There is a pivotable inner housing 26 that also has a retraction groove 13. A button 20 is accessible outside the case and attached to a transverse pin 22. The pin is connected to a keeper 24 to which a key K is attached. There is a sound dampening plug 28 of soft material such as cotton attached to the inner wall of the case. The user can slide the button 20 up the grooves 11 and 13 retracting the key K into the inner housing 26. The button is slid over in the groove 13 so that the inner housing 26 abuts the plug 28 to provide for sound dampening.

The foregoing written description and accompanying drawings are intended to be illustrative of the broader aspects of the invention. Therefore, they should not be construed so as to limit the scope of the appended claims.

The invention claimed is:

1. A key holder, comprising:

(a) an external housing;

(b) an internal housing, (c) means for pivotably mounting said internal housing inside said external housing;

(d) means by which keys can be retracted into said internal housing (e) means by which keys can be extended out of said internal housing while said internal housing remains within said external housing;

(f) means by which said internal housing can be rotated in relation to said external housing when the keys are retracted into said internal housing; and (g) means by which keys in the internal housing can be held under pressure while in a retracted position inside said internal housing comprising a plug of soft material;

wherein said external housing defines an internal chamber sized and configured to contain a remote key adjacent said internal housing when said internal housing is retracted into the key holder; and whereby the key holder dampens the rattling of keys held in a retracted position by being held under pressure while in a retracted position inside said internal housing.

2. The key holder of claim 1 wherein the external housing comprises a first and second section joined along an edge by hinge apparatus whereby the key holder can be opened to allow placement of the remote key into the internal chamber.

3. The key holder of claim 1 wherein the external housing defines an opening sized and positioned to allow the remote key to be inserted into and withdrawn out of the housing.

4. The key holder of claim 1 further comprising a flash light.

5. The key holder of claim 1 further comprising a cell phone.

6. A key holder, comprising:

(a) an external housing;

(b) an internal housing, (c) means for pivotably mounting said internal housing inside said external housing;

(d) means by which keys can be retracted into said internal housing (e) means by which keys can be extended out of said internal housing while said internal housing remains within said external housing;

(f) means by which said internal housing can be rotated in relation to said external housing when the keys are retracted into said internal housing; and (g) means by which keys in the internal housing can be held under pressure while in a retracted position inside said internal housing comprising a plug of soft material; and (h) a flashlight;

whereby the key holder dampens the rattling of keys held in a retracted position by being held under pressure while in a retracted position inside said internal housing.

7. The key holder of claim 6 wherein said external housing defines an internal chamber sized and configured to contain a remote key adjacent said internal housing when said internal housing is retracted into the key holder.

8. The key holder of claim 6 further comprising a cell phone.

* * * * *